US005957627A

United States Patent [19]

Stankus et al.

[11] Patent Number: 5,957,627

[45] Date of Patent: Sep. 28, 1999

[54] PILLAR CABLE TRUSS SYSTEM

[75] Inventors: John C. Stankus, Canonsburg; John G. Oldsen, Butler, both of Pa.; Brian R. Castle, Rolla, Mo.

[73] Assignee: Jennmar Corporation, Pittsburgh, Pa.

[21] Appl. No.: 08/972,283

[22] Filed: Nov. 18, 1997

Related U.S. Application Data

[60] Provisional application No. 60/031,386, Nov. 20, 1996.

[51] Int. Cl.[6] ..... E21D 20/00; E02D 3/02

[52] U.S. Cl. ..... 405/288; 405/259.1; 405/302.2

[58] Field of Search ..... 405/288, 302.2, 405/259.1, 303

[56] References Cited

U.S. PATENT DOCUMENTS

| | | | |
|---|---|---|---|
| 4,265,571 | 5/1981 | Scott | 405/259 |
| 4,634,318 | 1/1987 | Koumal | 405/259 |
| 4,749,310 | 6/1988 | White | 405/288 |
| 4,776,729 | 10/1988 | Seegmiller | 405/302.2 X |
| 4,946,315 | 8/1990 | Chugh et al. | 405/288 |
| 5,018,907 | 5/1991 | Chugh et al. | 405/288 |
| 5,238,329 | 8/1993 | Long et al. | 405/288 |
| 5,259,703 | 11/1993 | Gillespie | 405/302.2 X |
| 5,415,498 | 5/1995 | Seegmiller | 405/288 |
| 5,462,391 | 10/1995 | Castle et al. | 405/302.2 |
| 5,466,095 | 11/1995 | Scott | 405/302.2 |
| 5,584,608 | 12/1996 | Gillespie | 405/302.2 X |

*Primary Examiner*—Dennis L. Taylor

*Attorney, Agent, or Firm*—Webb Ziesenheim Logsdon Orkin & Hanson, P.C.

[57] ABSTRACT

A pillar cable truss system including a support cable extending between a pair of splice tubes mounted onto a geological formation such as a pillar in a coal mine with a pair of rock anchors. The splice tubes may be attached to two support cables such that sets of the support cables with splice tubes and rock anchors may be connected together to encircle a pillar. A vertically arranged elongated cable spacer tube is mounted onto the pillar with a rock anchor and includes openings through which the support cables extend. The spacer tube retains sets of the support cables apart from each other and/or allows the support cables to be installed in a crisscross pattern.

21 Claims, 6 Drawing Sheets

PILLAR CABLE TRUSS SYSTEM

This application claims the benefit of copending Provisional Application Ser. No. 60/031,386 filed Nov. 20, 1996.

BACKGROUND OF THE INVENTION

1. Field of the Invention

The present invention relates to a support structure for a geological formation in a mining environment and, more particularly, to a cable truss system for supporting pillars and the like in a mining environment.

2. Prior Art

Truss systems, such as roof support systems, are well known in the mining environment for providing support to the surrounding mine roof, walls, pillars and the like. U.S. Pat. Nos. 4,946,315 and 5,018,907 disclose typical mine roof truss systems utilizing interconnected tie rods extending between rigid roof bolts. U.S. Pat. No. 5,415,498 discloses a mine roof support system utilizing a flexible cable in place of tie rods extending between rigid rock anchors or bolts. A variety of cable truss systems has been developed such as disclosed in U.S. Pat. Nos. 4,265,571; 5,462,391 and 5,466,095. The difficulties with the known prior art systems are that the prior art truss systems do not provide cost-effective systems adapted for a variety of applications. Most of the prior art requires highly specialized pieces, making the resulting truss system overly complicated, impractical and non-economical to manufacture.

SUMMARY OF THE INVENTION

An object of the present invention is to overcome the aforementioned drawbacks of the prior art. A further object of the present invention is to provide a support structure for a geological formation in a mining environment which is economical to manufacture and easy to use so as to promote industry acceptance thereof. A further object of the present invention is to provide a support structure which is easily adapted for use as a pillar support in a mining environment.

These objects are met by the present invention which includes a support structure for a geological formation having a pair of connectors and a support cable coupled at each end thereof to one of the connectors. The connectors are each adapted to receive a rock anchor therethrough and each includes a conduit disposed between a pair of ends. The conduit is adapted to receive two support cables therethrough. A rock anchor, preferably a cable bolt, extends through each of the connectors and is adapted to be inserted into the geological formation. The support cable includes a cable attachment which preferably is a barrel and wedge assembly. The attachment has a diameter larger than inner dimensions of the conduit of the connector and is adapted to abut against one end of the connector. The conduit preferably has constant inner dimensions between the ends of the conduit and defines a pair of aligned openings through which the rock anchor extends. The openings in the conduit are sized to prevent the rock anchor from passing therethrough. The support structure further includes a roof support plate adapted to be urged towards the geological formation by the support cable. The roof support plate includes a planar member having an abutment surface facing the geological formation and a support cable engaging member extending from the planar member and adapted to secure the support cable to the roof support plate.

The support structure may further include another support cable coupled at one end thereof to one of the connectors and another connector coupled to the other end of the another support cable. Another rock anchor extends through the another connector. Alternatively, the support structure may include a plurality of the connectors connected together via a plurality of the support cables with a rock anchor extending through each of the connectors. In this manner, the support structure is adapted to surround the geological formation.

The support structure may further include a plurality of support cables, a plurality of pairs of connectors, each connector coupled to an end of one of the support cables, a rock anchor extending through each connector and a cable support spacer. The cable support spacer includes a spacer body adapted to receive at least two of the support cables therethrough and adapted to receive another rock anchor therethrough. The spacer body defines at least two support cable openings extending therethrough and preferably includes a hollow elongated member disposed between a pair of ends. One of the support cables extends through each of the support cable openings in the spacer body. A rock anchor opening is defined in the spacer body so that the another rock anchor extends through the rock anchor opening in the spacer body. Preferably, the support cable openings are substantially perpendicular to the rock anchor openings. The rock anchor opening in the elongated member is sized to prevent the rock anchor from passing therethrough. The support cables may be laced through the support cable openings in the spacer body such that at least two of the support cables extend substantially parallel to each other. The support cable may also be laced through the support cable openings in the spacer body such that at least two of the support cables cross over each other.

The objects of the present invention will be clarified in the description of the preferred embodiments taken together with the attached figures wherein like reference numerals represent like characters throughout.

DESCRIPTION OF THE PREFERRED EMBODIMENTS

Figure 1:
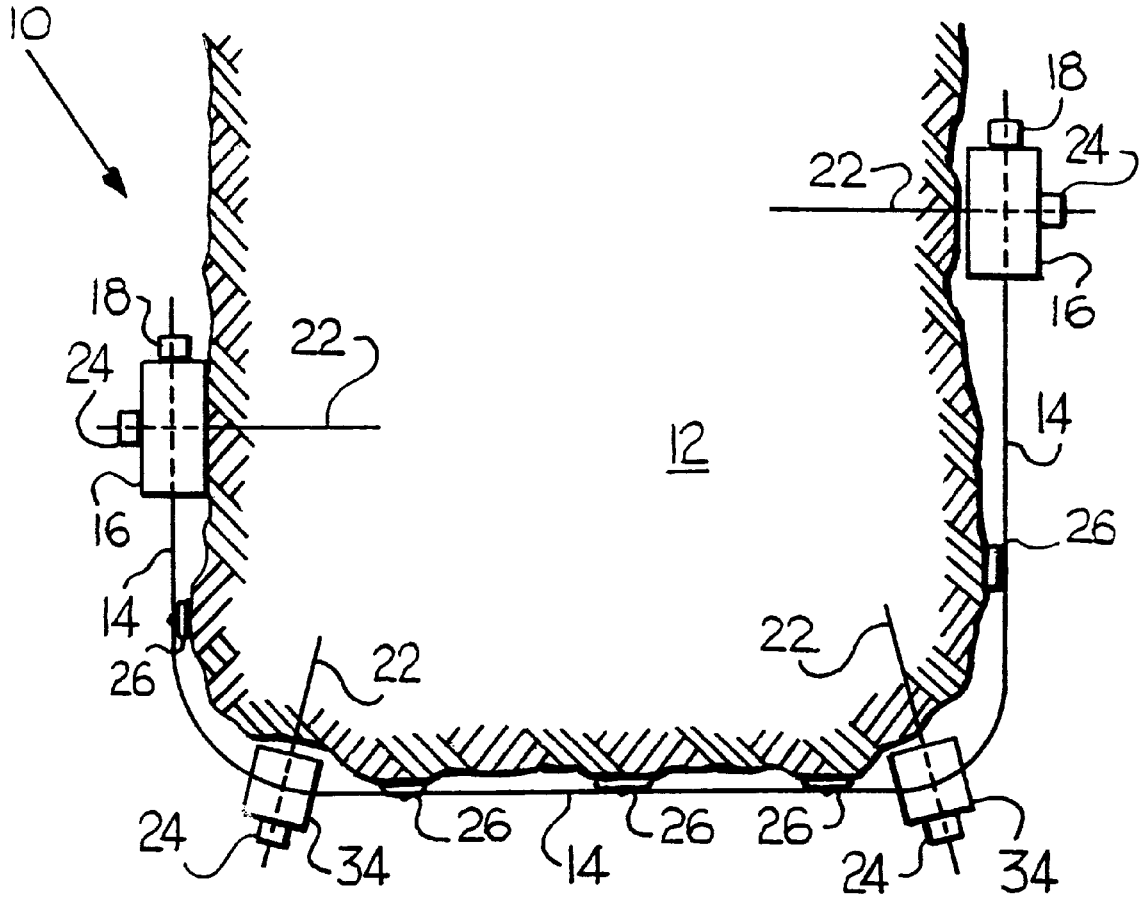
FIG. 1 is a top view schematically illustrating a cable truss system installed on a pillar and made in accordance with the present invention.
Figure 2:
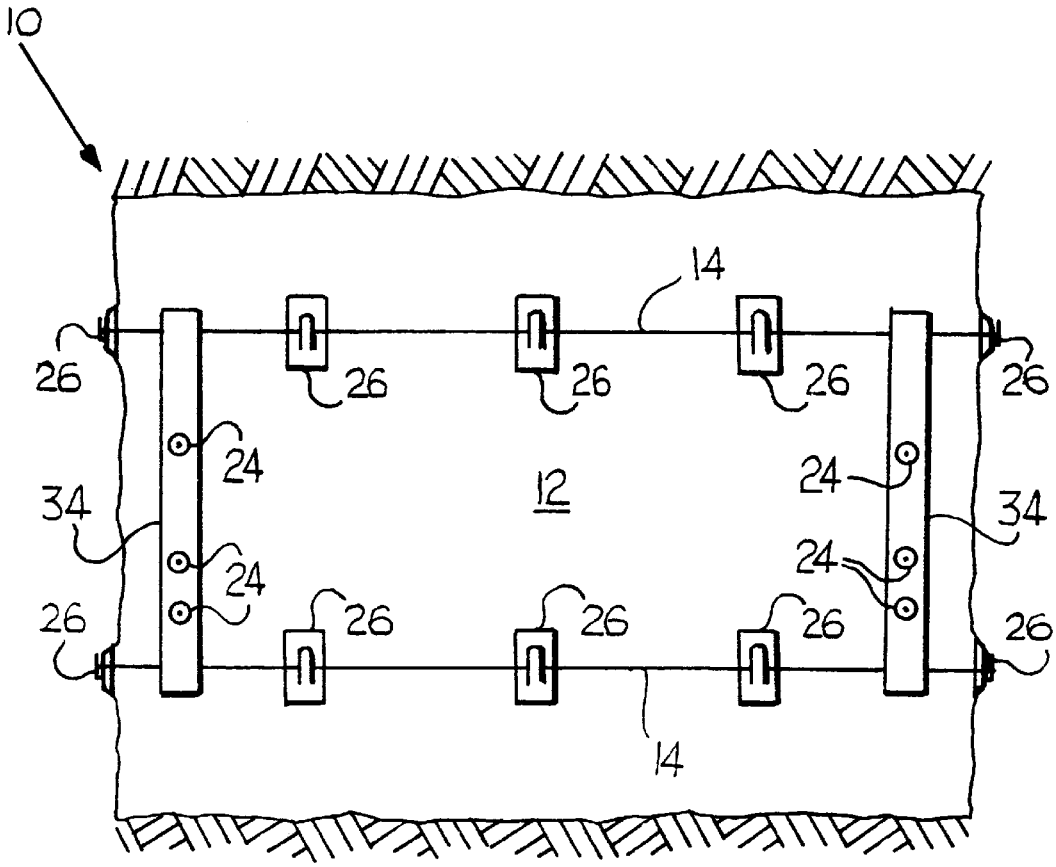
FIG. 2 is a front view schematically illustrating the cable truss system of FIG. 1.
Figure 3:
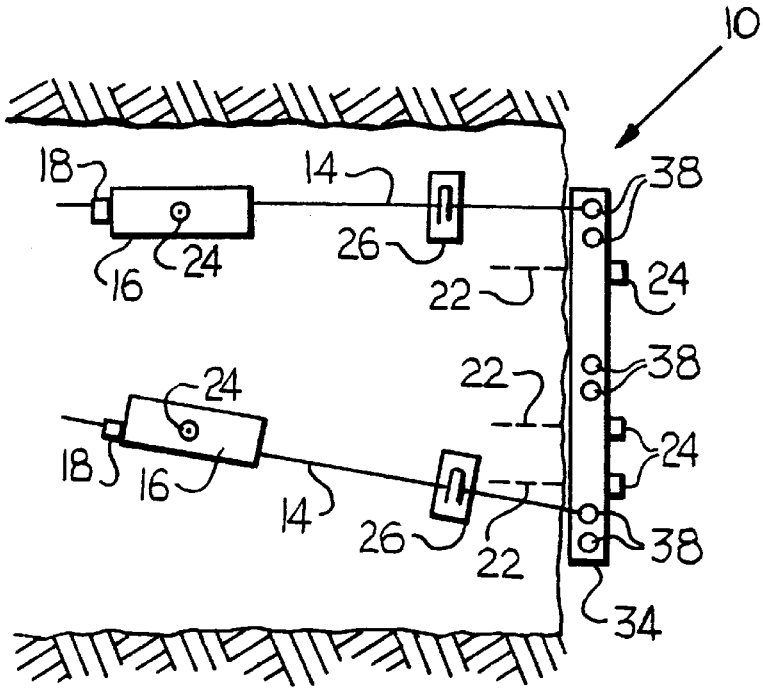
FIG. 3 is a side view schematically illustrating the cable truss system of FIG. 1.

FIGS. 1–3 schematically illustrate a cable truss system or support structure 10 for supporting a pillar or other geological formation 12 in a mine. In a mining environment, a pillar 12 vertically extends between the mine floor and the mine roof and may have sides of over one hundred feet long. The cable truss system 10 of the present invention may also be used against a mine roof, mine wall or similar formation. However, as will be clarified hereinafter, the cable truss system 10 is particularly well suited for use with a pillar 12 or the like. Typically, the cable truss system 10 will overlay a conventional mesh screen and/or matting material (not shown) positioned adjacent the pillar 12 to help contain the rock mass.

The cable truss system 10 includes a plurality of support cables 14 extending around the pillar 12 between connectors or splice tubes 16. The present cable truss system 10 is related to the mine roof support system described in copending U.S. patent application Ser. No. 08/659,040, filed on Jun. 3, 1996 entitled "Mine Roof Support System" (hereinafter "the '040 application") which is incorporated herein by reference. When using the cable truss system 10 for pillars 12 or the like, ½" diameter cables are sufficient for support cables 14 due to the loading requirements of the cable truss system 10 in the substantially vertical arrangement of the pillar 12. Greater diameter cables can be utilized where greater loading requirements are needed.

Both ends of each of the support cables 14 are provided with a load-bearing cable attachment member 18. The attachment member 18 may be effectively formed as a conventional barrel and wedge assembly. A conventional barrel and wedge assembly is a standard load-bearing cable attachment including a substantially cylindrical barrel having a tapered opening therein for receiving a cable therethrough with a plurality of locking wedges surrounding the cable within the tapered opening of the barrel for securing the barrel to the cable. After the barrel and wedge assembly is secured to the cable, the front face of the barrel and wedge assembly will provide a load-bearing surface for loading of the support cable 14.

Figure 6:
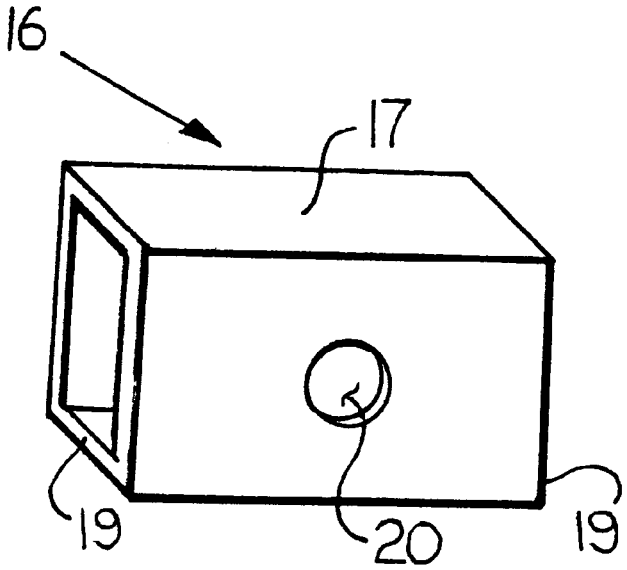
FIG. 6 is a perspective view of a splice tube used in the cable truss system illustrated in FIG. 1.
Figure 7:
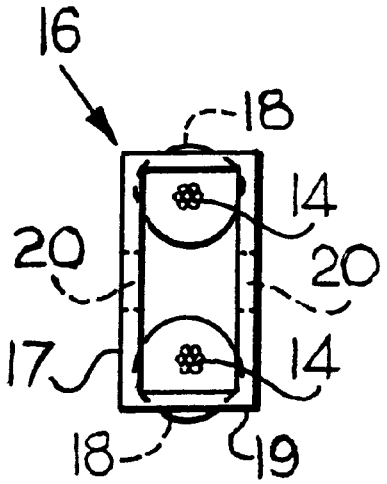
FIG. 7 is an elevation view of one end of the splice tube illustrated in FIG. 6.
Figure 8:
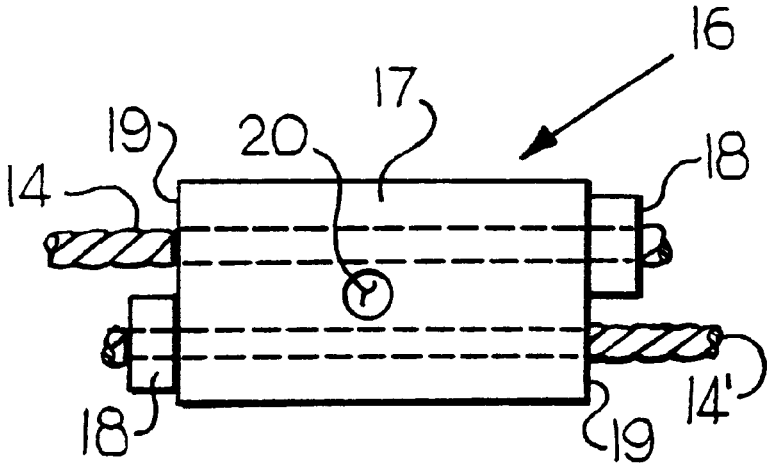
FIG. 8 is a plan view of the splice tube used in the cable truss system illustrated in FIG. 5.

Each splice tube 16 is positioned on the support cable 14 adjacent one of the attachment members 18. The splice tube 16 is best illustrated in FIGS. 6, 7 and 8 and is formed of an elongated conduit 17 between a pair of spaced ends 19. The splice tubes 16 are substantially identical to the splice tube illustrated in FIG. 3A of the '040 application, except that the splice tube 16 includes a pair of aligned openings 20 extending substantially perpendicular to the longitudinal axis of the conduit 17 as shown in FIG. 7. The conduit 17 receives a pair of support cables 14 therethrough as illustrated in FIGS. 7 and 8. The attachment member 18 (shown in phantom) has a diameter larger than the inner dimensions of the conduit 17 of the splice tube 16 so that the attachment member 18 abuts against one of the ends 19 of the splice tube 16.

Effective splice tubes 16, according to the present invention, have been formed out of a generally rectangular configuration having dimensions of the conduit 17 of the splice tube 16 of an opening of 2" by 1" with the thickness of the conduit 17 being approximately ¼" thick when the splice tube 16 is formed of steel. Although described herein as having a rectangular configuration, the splice tube 16 may be formed in other configurations such as a square or other geometric form. The length of a splice tube 16 is preferably long enough such that the compressive forces acting on the splice tube 16 will act along a substantial length of the splice tube 16. A length of greater than 7" has been found to be preferable with a length of about 8" forming a very effective splice tube 16 according to the present invention.

A pair of aligned openings 20 is defined in the splice tube 16 (FIG. 7) and extend substantially perpendicular to the longitudinal axis of the splice tube 16. The openings 20 are preferably defined in the longer sides of the rectangular cross section of the splice tube 16.

The aligned openings 20 of the splice tube 16 are adapted to receive a rock anchor 22 therethrough for attaching the splice tube 16 to the pillar 12 as shown in FIG. 1. The rock anchor 22 can be a cable bolt or a conventional rock bolt. A conventional cable bolt is a length of multistrand cable which typically is adapted to be chemically anchored at a blind end of a borehole and having a bolt head at a free end of the bolt. When installed into the rock of the pillar 12, a bolt head 24 of the rock anchor 22 will bear against the conduit 17 of the splice tube 16. In a cable bolt arrangement such as shown in the drawings, the bolt head 24 may be formed by a conventional barrel and wedge assembly adjacent the conduit 17 of the splice tube 16 as depicted in FIGS. 1 and 3.

Figure 9:
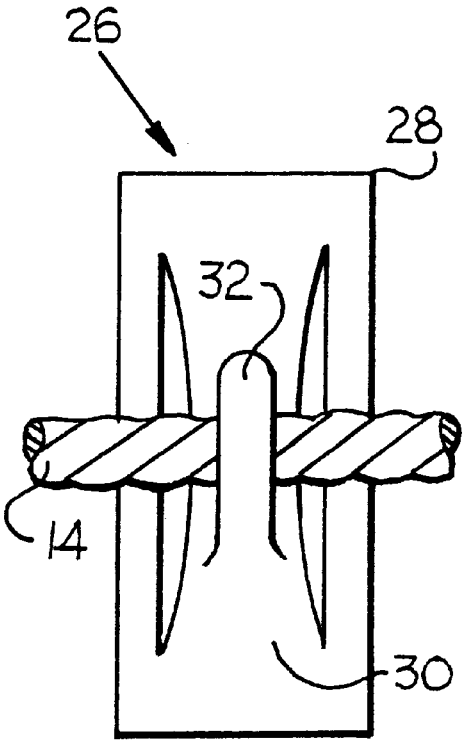
FIG. 9 is a plan view of a roof support plate used in the cable truss system illustrated in FIG. 1.
Figure 10:
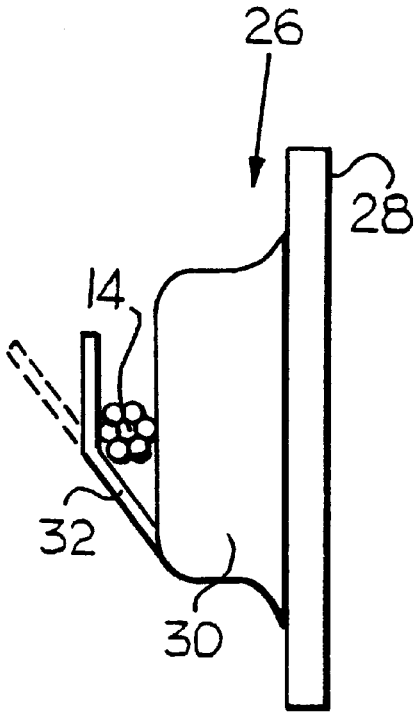
FIG. 10 is a side view of the roof support plate illustrated in FIG. 9.

A plurality of support plates 26 is held against the pillar 12 by the support cable 14. The individual support plates are the type illustrated in FIGS. 4–7 of the '040 application and shown in detail here in FIGS. 9 and 10. Each roof support plate 26 includes a generally planar load-bearing surface 28 positioned to face the geological formation. A raised support member 30 extends up from the load-bearing surface 28. An engaging member or clamping finger 32 extends from the raised support member 30 and is adapted to clamp the support cable 14 between the clamping finger 32 and the raised support member 30 to secure the roof support plate 26 to the support cable 14. The roof support plates 26 are configured for easy manufacture by being stamped out of appropriate steel plates on a hydraulic press.

Figure 11:
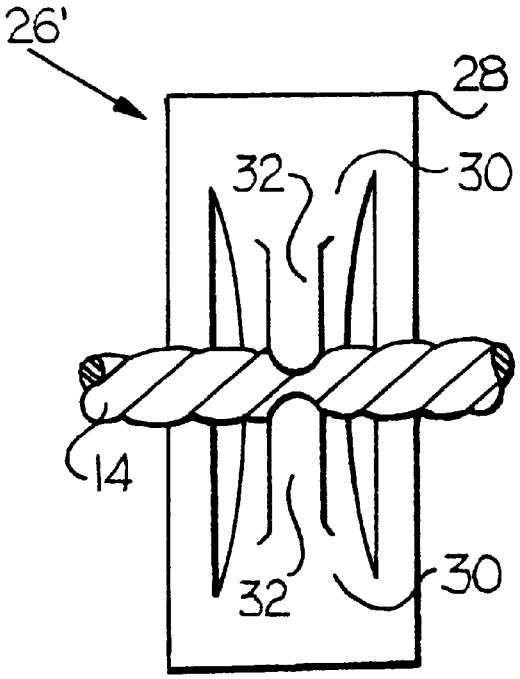
FIG. 11 is a plan view of a modified roof support plate utilized in the cable truss system illustrated in FIG. 1.
Figure 12:
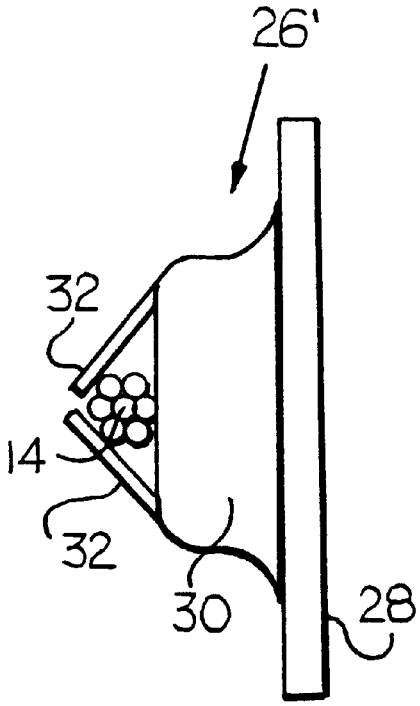
FIG. 12 is a side view of the roof support plate illustrated in FIG. 11.
Figure 13:
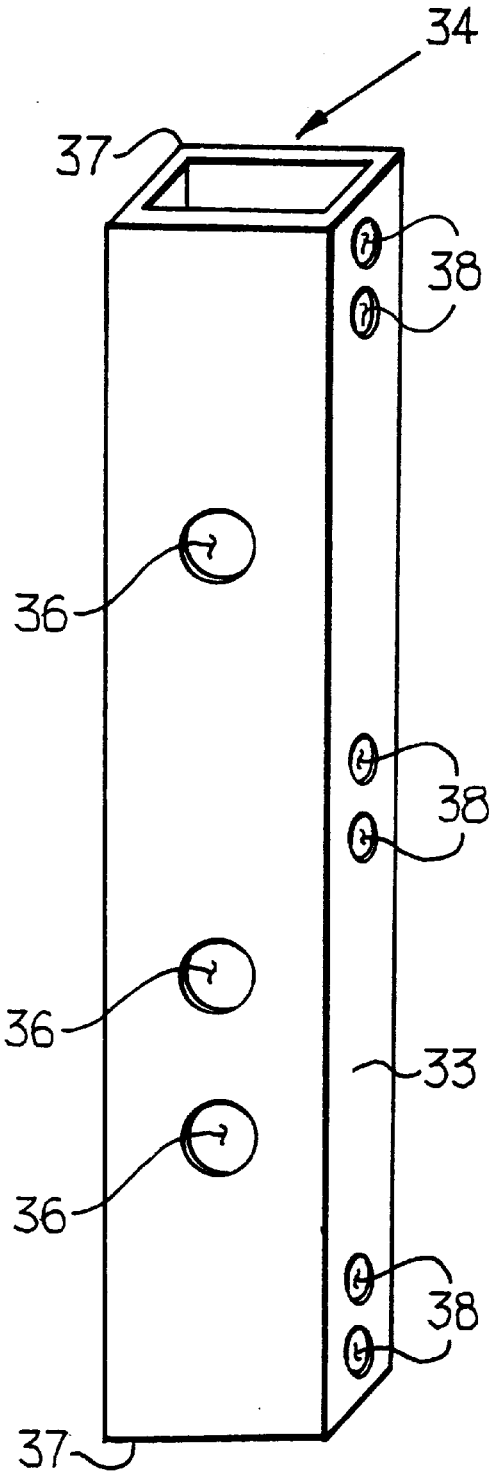
FIG. 13 is a perspective view of a spacing tube used in the cable truss system illustrated in FIG. 1.

FIGS. 11 and 12 illustrate a modified roof support plate 26' according to the present invention. The modified roof support plate 26' includes a load-bearing surface 28 and raised support member 30 substantially the same as roof support plates 26 described above. The modified roof support plate 26' includes a pair of clamping fingers 32 extending from the raised support member 30 as shown in FIGS. 12 and 13. The clamping fingers 32 of the modified roof support plate 26' are adapted to clamp the support cable 14 between the clamping fingers 32 and the raised support member 30 substantially the same as in the roof support plate 26. The support plates 26 are positioned as needed along the support cable 14 and will be typically held against the underlying mesh (not shown) surrounding the pillar 12 thus supporting the rock mass.

Figure 4:
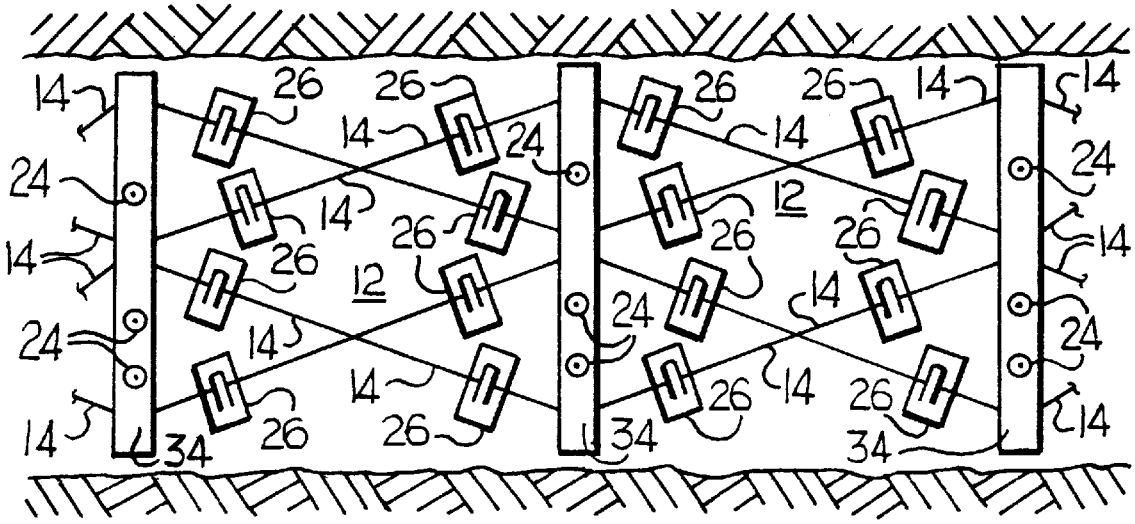
FIG. 4 is a front view of the cable truss system illustrated in FIG. 1 schematically illustrating a modified lacing arrangement.

Returning to FIGS. 1–3, the support cables 14 pass through cable support spacers or spacing tubes 34 which are attached to the pillar 12 by rock anchors 22 having bolt heads 24 bearing against the spacing tubes 34. The spacing tubes 34 maintain appropriate spacing between support cables 14 as illustrated in FIGS. 2 and 3. The spacing tubes 34 also allow for angling of the support cable 14 to accommodate various cable lacing arrangements as shown in FIG. 4.

Figure 14:
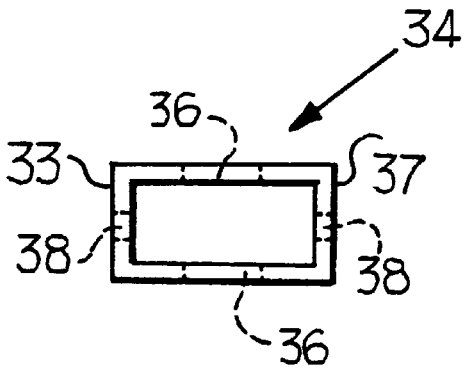
FIG. 14. is an elevation view of the spacing tube illustrated in FIG. 13.

The spacing tubes 34 are shown in greater detail in FIGS. 13 and 14. The spacing tubes 34 preferably include a spacer body 33 having a plurality of rock anchor openings 36 extending therethrough. The spacer body preferably includes a hollow elongated member having a rectangular cross section and being disposed between a pair of ends 37. As with the splice tube 16, the spacing tubes 34 are described herein as having a rectangular configuration but may be formed in other geometric configurations. The rock anchor openings 36 are adapted to receive the rock anchors 22 therethrough for attaching the spacing tube 34 to the pillar 12. The rock anchor openings 36 will generally be positioned through the longer sides of the rectangular cross section member. The spacing tube 34 additionally includes a plurality of cable openings 38 extending therethrough and preferably extending substantially perpendicular to the rock anchor openings 36. The cable openings 38 are adapted to selectively receive support cables 14 therethrough to maintain the appropriate spacing between support cables 14 as shown in FIGS. 2 and 3.

The quantity of rock anchor openings 36 in the spacing tube 34 is selected to adequately secure the spacing tube 34 to the pillar 12. Additionally, the rock anchor openings 36 must be offset from the cable openings 38 such that the rock anchors 22 do not interfere with the passage of the cables 14 through the cable openings 38. Additionally, the plurality of cable openings 38 is provided to accommodate multiple support cables 14 in a variety of lacing arrangements as will be described hereinafter.

The splice tubes 16 are preferably manufactured by cold forming rolled A500 Grade B steel and welding a seam to form a welded structural steel tube and subsequently finished by drilling openings 20 therethrough. The spacing tubes 24 are preferably formed by the same process used to form the conduits of the splice tubes 16 and subsequently finished by drilling the rock anchor openings 36 and the cable openings 38 therethrough. As a result of the preferred manufacturing process and as shown in FIG. 7, the splice tube 16 has a set of inner dimensions which is substantially constant along the length of the splice tube 16 between the ends 19. Likewise, as shown in FIG. 14, the spacing tube 34 has a set of inner dimensions which is substantially constant along the length of the spacing tube 34 between the ends 37. The openings 20 of the splice tube 16 and the rock anchor openings 36 of the spacing tube 34 are adapted to receive rock anchors 22 therethrough and must be sized accordingly. Typically, a 1 ⅛" diameter opening will be sufficient for receiving a cable bolt therethrough. The cable openings 38 must be appropriately sized to receive the support cables 14 therethrough.

Figure 15:
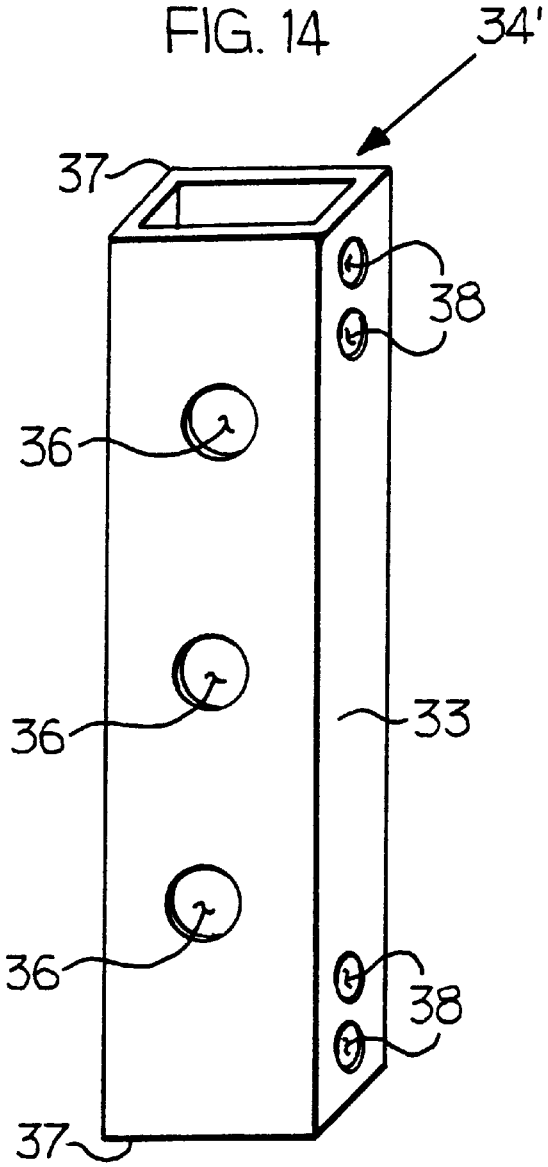
FIG. 15 is a perspective view of a modified spacing tube used in the cable truss system illustrated in FIG. 1.

FIG. 15 illustrates a generally shorter, modified spacing tube 34' having an alternative arrangement for the rock anchor openings 36 and the support cable openings 38. The spacing tube 34' illustrated in FIG. 15 would be about 72" long while the modified spacing tube 34' is about 60". However, the spacing tubes may be formed of any desired length with any variety of spaced rock anchor openings 36 and support cable openings 38. FIGS. 13 and 15 are merely illustrative of the variety of configurations available.

FIG. 4 illustrates a more intricate crisscross lacing arrangement for the support cables 14 of the cable truss system 10 of the present invention. As shown in FIG. 4, the spacing tubes 34 also allow for the angling of the support cable 14 to more easily accommodate crisscrossing or overlapping patterns to be achieved. It should be appreciated that a wide variety of cable lacing arrangements is achievable with the spacing tubes 34 and the cable truss system 10 of the present invention.

Figure 5:
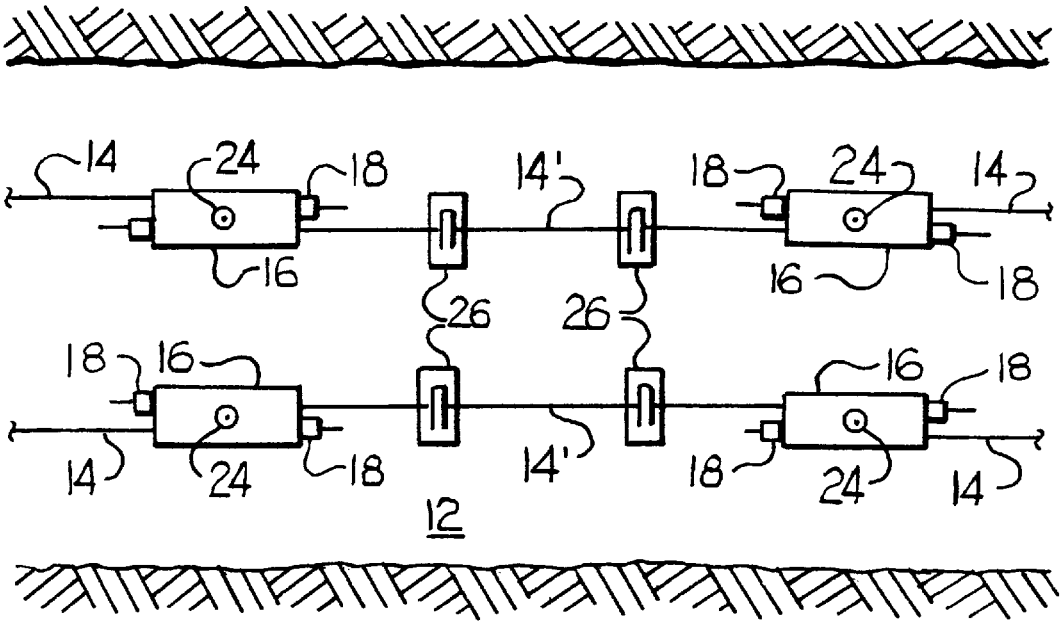
FIG. 5 is a side view schematically illustrating a continuation of the cable truss system illustrated in FIG. 3.

The cable truss system 10 of the present invention provides for a segmented, expandable truss system. This is schematically illustrated in FIG. 5. The cable truss system 10 allows additional support cables 14' to be added from existing splice tubes 16 to continue the cable truss system 10 along the pillar 12 or to connect preexisting splice tubes 16. With this construction, sections of the cable truss system 10 can be added or removed, as desired, allowing for operation on the pillar 12, if needed. The additions of continuing segments off a preexisting splice tube 16, such as shown in FIG. 5, create great flexibility in the cable truss system 10 of the present arrangement. The additional support cables 14' shown in FIG. 5 may additionally use spacing tubes 34 or 34' for various lacing configurations such as shown in FIG. 4, as needed. The splice tubes 16 are sized to accommodate two support cables 14 or 14' passing therethrough together with a rock anchor 22 having a bolt head 24 extending perpendicular to the support cables 14 or 14'.

The installation of the cable truss system according to the present invention operates as follows. Boreholes are drilled into the geological formation in a conventional fashion. The rock anchor bolts 22 are inserted through the splice tube openings 20 and the rock anchor openings 36 in the spacing tubes 34 and into the drilled boreholes. The rock anchors 22 are secured within the boreholes using conventional expansion anchors or chemical anchors in a conventional manner. The support cables 14 are laced through the conduits 17 of the splice tubes 16 and support cable openings 38 in the spacing tubes 34. The support cable attachment members 18 are secured to the ends of the support cables 14. The roof support plates 26 are attached along the support cables 14 and secured in position by clamping the respective clamping fingers 32 against the support cables 14 to clamp the support cables 14 between the clamping fingers 32 and the raised support members 30. The cable truss system 10 is then tensioned by attaching a hydraulic tensioning device to an end of the support cable 14 protruding beyond the cable attachment member 18.

The cable truss system 10 of the present invention provides a flexible, easily installed cable truss system which can be utilized in a wide variety of configurations. The components of the cable truss system 10 are easily manufactured and utilize a large collection of elements common to the mining industry. For example, the body of the splice tubes 16 and spacing tubes 34 can have generally the same configuration and be manufactured in the same cold forming process. Following the cold forming process, the only subsequent manufacturing steps are cutting the tube bodies to length for the splice tubes 16 or the spacing tubes 34 as needed and drilling the openings 20, rock anchor openings 36 and support cable openings 38. The splice tubes 16 and spacing tubes 34 are attached to the pillar 12 by conventional rock anchor bolts 22. Similarly, the cable attachment members 18 can be formed of a conventional barrel and wedge assembly well known in the mining industry for use with cable bolts and the like. The support plates 26 are also easily manufactured from a single die. The simplicity and versatility of the cable truss system 10 provides significant advantages over the prior art structures.

It will be apparent to those of ordinary skill in the art that various modifications may be made to the present invention without departing from the spirit and scope thereof. Such modifications are to be considered as included within the following claims unless the claims, by their language, expressly state otherwise. Accordingly, the particular embodiments described in detail hereinabove are illustrative only and are not limiting as to the scope of the invention which is to be given the full breadth of the appended claims and any and all equivalents thereof.

We claim:

1. A support structure for a geological formation comprising:

a pair of connectors, each said connector adapted to receive a rock anchor therethrough and comprising a conduit, said conduit adapted to receive two support cables therethrough;

a pair of rock anchors, each said rock anchor extending through one of said connectors and adapted to be inserted into the geological formation; and a support cable, each end of said support cable being coupled to one of said connectors such that said support cable extends through each said connector and each end of said support cable is configured to be coupled to another of said connectors.

2. The support structure of claim 1 wherein said support cable includes a cable attachment wherein said cable attachment has a diameter larger than inner dimensions of said conduit of said connector and wherein said cable attachment is adapted to abut against one end of said conduit of connector.

3. The support structure of claim 2 wherein said cable attachment comprises a barrel and wedge assembly.

4. The support structure of claim 3 wherein each said conduit has substantially constant inner dimensions such that each said barrel and wedge assembly abuts an end of one of said conduits.

5. The support structure of claim 4 wherein each said conduit defines a pair of aligned openings in opposing sides of said conduit through which said rock anchor extends.

6. The support structure of claim 1 further comprising a roof support plate adapted to be urged towards the geological formation by said support cable, said roof support plate comprising:

a planar member having an abutment surface facing the geological formation and a support cable engaging member extending from said planar member and adapted to secure said support cable to said roof support plate.

7. The support structure of claim 1 further comprising:

another said support cable, said another support cable coupled at one end thereof to one of said connectors;

another said connector, said another connector coupled to the other end of said another support cable; and another said rock anchor extending through said another connector.

8. The support structure of claim 7 further comprising:

a plurality of said connectors;

a plurality of said rock anchors, each said rock anchor extending through one of said connectors; and a plurality of said support cables coupled at each end thereof to one of said connectors, wherein each said connector is coupled to two of said support cables such that said support structure is adapted to surround the geological formation.

9. The support structure of claim 1 wherein each said rock anchor comprises a cable bolt.

10. A support structure for a geological formation comprising:

a plurality of support cables;

a plurality of pair of connectors, each said connector coupled to an end of one of said support cables such that each said support cable extends through at least a pair of said connectors, each end of said support cable being configured to be coupled to another of said connectors, said connectors each adapted to receive a rock anchor therethrough and comprising a conduit, said conduit adapted to receive two of said support cables therethrough; and a plurality of rock anchors, each said rock anchor extending through one of said connectors and adapted to be inserted into the geological formation.

11. The support structure of claim 10 wherein each said support cable includes a cable attachment, wherein each said cable attachment has a diameter larger than inner dimensions of each said conduit connector and wherein each said cable attachment is adapted to abut against one end of each said connector.

12. The support structure of claim 11 wherein each said cable attachment comprises a barrel and wedge assembly.

13. The support structure of claim 12 wherein each said conduit has substantially constant inner dimensions such that each said barrel and wedge assembly abuts an end of one of said conduits.

14. The support structure of claim 13 wherein each said conduit defines a pair of aligned openings in opposing sides of said conduit through which each said rock anchor extends.

15. The support structure of claim 10 further comprising a plurality of roof support plates, each said roof support plate adapted to be urged towards the geological formation by said support cable, each said roof plate comprising:

a planar member having an abutment surface facing the geological formation and a support cable engaging member extending from said planar member and adapted to secure one of said support cables to said roof support plate.

16. The support structure of claim 10 wherein each said rock anchor comprises a cable bolt.

17. The support structure of claim 10 further comprising a support cable spacer, said cable support spacer comprising a spacer body adapted to receive at least two of said support cables therethrough and adapted to receive another of said rock anchors therethrough.

18. The support structure of claim 17 further comprising a plurality of said support cable spacers.

19. The support structure of claim 18 wherein each said spacer body defines at least two support cable openings, each said support cable extending through one of said support cable openings in said spacer body, and wherein said spacer body further defines a rock anchor opening, each said rock anchor extending through one of said rock anchor openings.

20. The support structure of claim 19 wherein at least two of said support cables are laced through said support cable openings in said spacer body such that said at least two support cables extend substantially parallel to each other.

21. The support structure of claim 19 wherein at least two of said support cables are laced through said support cable openings in said spacer body such that said at least two support cables cross over each other.

* * * * *